United States Patent [19]

Imai et al.

[11] Patent Number: 4,839,337

[45] Date of Patent: Jun. 13, 1989

[54] DYE-RECEIVING SHEETS FOR THERMAL DYE TRANSFER PRINTING COMPRISING A COMPOSITE FILM SUBSTRATE

[75] Inventors: Akihiro Imai, Ikoma; Hiromu Matsuda; Keiichi Yubakami, both of Osaka; Nobuyoshi Taguchi, Ikoma, all of Japan

[73] Assignee: Matsushita Electric Industrial Co., Ltd., Japan

[21] Appl. No.: 111,433

[22] Filed: Oct. 21, 1987

[51] Int. Cl.[4] ..... B41M 5/35; B41M 5/26

[52] U.S. Cl. ..... 503/227; 8/471; 428/195; 428/212; 428/323; 428/328; 428/330; 428/331; 428/403; 428/412; 428/423.7; 428/447; 428/475.2; 428/480; 428/913; 428/914

[58] Field of Search ..... 8/470, 471; 428/195, 428/206, 207, 323, 328, 330, 423.1, 447, 480, 913, 914, 212, 331, 403, 412, 423.7, 473.4, 475.2, 532; 430/945; 503/227

[56] References Cited

U.S. PATENT DOCUMENTS

| | | | |
|---|---|---|---|
| 4,720,480 | 1/1988 | Ito et al. | 503/227 |

FOREIGN PATENT DOCUMENTS

| | | | |
|---|---|---|---|
| 0209359 | 1/1987 | European Pat. Off. | 503/227 |
| 0234563 | 9/1987 | European Pat. Off. | 503/227 |
| 54-96052 | 7/1979 | Japan | 503/200 |
| 61-284486 | 12/1986 | Japan | 503/200 |
| 61-295085 | 12/1986 | Japan | 503/227 |
| 62-32085 | 2/1987 | Japan | 503/227 |
| 2183354 | 6/1987 | United Kingdom | 503/227 |

*Primary Examiner*—Bruce H. Hess

*Attorney, Agent, or Firm*—Lowe, Price, Leblanc, Becker & Shur

[57] ABSTRACT

A dye-receiving sheet comprising a substrate and a dye-receiving layer formed on one side of the substrate, the substrate being made of an extruded sheet of a mixture of white fine particles and a polyester resin and a layer of a polymer material or composition whose thermal deformation temperature or softening point is lower than that of the extruded sheet. This sheet has high printing sensitivity.

27 Claims, 1 Drawing Sheet

DYE-RECEIVING SHEETS FOR THERMAL DYE TRANSFER PRINTING COMPRISING A COMPOSITE FILM SUBSTRATE

BACKGROUND OF THE INVENTION

1. Field of the Invention

This invention relates to the art of thermal printing and more particularly, to dye-receiving sheets for thermal dye transfer printing on which a dye sublimating from a dye-transfer sheet is received in an imagewise pattern.

2. Description of the Prior Art

Substrates of dye-receiving sheets which are used in thermal transfer printing should have a small degree of curling when heated, and high brightness. To this end, studies have been made on extruded sheets made of mixtures of white fine particles and polyester resins because of the small degree of curling and high brightness. When, however, a dye-receiving sheet using the extruded sheet substrate and a dye transfer sheet are used in combination for the thermal transfer printing, a disadvantage is involved in that because of the rigidity or hardness of the substrate, the dye-receiving sheet and the dye transfer sheet do not contact intimately, resulting in a lowering of the print density.

SUMMARY OF THE INVENTION

An object of the invention is to provide a dye-receiving sheet which is used in sublimable dye transfer thermal printing systems using heating means such as thermal heads, laser beams, electric heating and the like and which exhibits high sensitivity for the printing.

Another object of the invention is to provide a dye-receiving sheet which makes use of a composite film substrate which suffers little curling when heated and has high brightness.

The present invention provides a dye-receiving sheet which is used in combination with a sublimable dye transfer sheet and which comprises a composite film substrate made of an extruded sheet of white fine particles and a polyester resin and a layer of a polymer material formed on at least one side of the extruded sheet and having a thermal deformation temperature or softening point lower than the extruded sheet. A dye-receiving layer may be formed on either side of the composition film substrate. The term "polymer material" used herein is intended to mean polymers per se or polymer compositions as will be descibed in more detail hereinafter.

DETAILED DESCRIPTION AND EMBODIMENTS OF THE INVENTION

As described above, the present invention is characterized in that a composite film substrate is made of an extruded sheet comprised of white fine particles dispersed in a polyester resin and a layer of a polymer material or composition formed on at least one side of the extruded sheet. The polymer material or composition should have a thermal deformation temperature or softening point lower than the extruded sheet. A dye-receiving layer is formed on either the at least one side or the other side to obtain a dye-receiving sheet.

Figure 1:
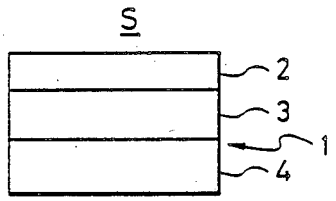
FIG. 1 is a schematic side view of a dye-receiving sheet according to one embodiment of the invention.

Reference is now made to the accompanying drawings, in which like reference numerals indicate like parts or members, and particularly to FIG. 1. In FIG. 1, there is shown a dye-receiving sheet S according to one embodiment of the invention. The dye-receiving sheet S includes a composite film substrate 1 and a dye-receiving layer 2 formed on one side of the substrate 1. The substrate 1 is made of an extruded sheet 3 and a polymer layer 4 formed on the other side with respect to the dye-receiving layer 2. The extruded sheet 3 is constituted of white fine particles and a polyester resin and is formed by extrusion of a mixture of the white fine particles dispersed in the polyester resin. This sheet 3 is preferably extended or oriented either monoaxially or biaxially.

Although the specific gravity of the extruded sheet 3 is not critical, it is preferred that the specific gravity is so controlled by extension as to be not larger than 1.38. Most preferably, an extruded sheet having a specific gravity not larger than 1.2 is used in view of the flexibility. Moreover, it is preferred that the extruded sheet 3 has a thickness of from 20 to 500 micrometers.

The particle size and kind of white fine particles are not limited, and the average size is preferably not larger than 10 micrometers. Examples of the materials for the particles include alumina, silica, calcium carbonate, magnesium carbonate, calcium silicate, titanium oxide, barium sulfate, silicones and the like. Of these, titanium oxide, barium sulfate and calcium carbonate are preferred because of the ease in obtaining a sheet having high brightness.

The white fine particles may be added in an amount of from 1 to 100 wt % of the polyester resin.

When the white fine particles are treated with surface improvers such as silane coupling agents, titanate coupling agents, aluminum coupling agents and the like, the dispersability of the treated particles or the flexibility of the resultant extruded sheet is improved, leading to better results. Furthermore, if a fluorescent brighteners or antistatic agents are added for use in combination with the white fine particles, the resultant sheet has improved brightness and improved electrostatic properties at the time of printing.

The polyester resins used for the extruded sheet are not critical and are preferably polyethylene terephthalate resins, polyethylene naphthalate resins and the like.

The polymer layer 4 is formed on at least one side of the extruded sheet 3. This layer is made of a polymer material or polymer composition whose thermal deformation temperature or softening point is lower than that of the extruded sheet. The layer of the polymer material or composition may be formed on the extruded sheet by coating, lamination and other known techniques. When various synthetic papers are, for instance, laminated on the extruded sheet through an adhesive layer, a composite substrate of good properties can be obtained.

The polymer layer may have a multi-layered structure in which at least one layer should be made of a polymer material or polymer composition whose thermal deformation temperature or softening point is lower than that of the extruded sheet. In this connection, the laminated substrate using an adhesive layer may be considered as a kind of multi-layered structure.

The thermal deformation temperature or softening point may be determined either before a polymer material or polymer composition is applied onto the extruded sheet, or after the application.

The term "thermal deformation temperature" used herein is intended to mean a temperature which is determined according to the method prescribed in ASTM D648 in which a load of 18.6 kg/cm$^2$ is used.

Likewise, the term "softening point" may be a temperature which is determined according to the Vicat softening point test method, the flow tester method (using, for example, Shimadzu Flow Tester CFT-500, available from Shimadzu Corporation) or a penetration test using a thermomechanical analyzer (using, for example, TM-7000 of Shinku-Riko Inc.). For comparison between the extruded sheet and the polymer material or composition with respect to the softening point or thermal deformation temperature, the same measuring method should be used.

Especially, when the difference in the thermal deformation temperature or softening point between a polymer material or composition and the extruded sheet is 20° C. or over, good results are obtained.

The polymer materials may be various synthetic and natural resins including, for example, polyethylene, polypropylene, vinyl chloride resins, vinylidene chloride resins, ionomer resins, vinyl chloride copolymers such as, for example, vinyl chloride-vinyl acetate copolymers, vinyl chloride-vinylidene chloride copolymers and the like, ethylene copolymers such as, for example, ethylene-vinyl acetate copolymers, ethylene-acrylic acid copolymers, ethylene-ethyl acrylate copolymers, ethylene-ethyl methacrylate copolymers, ethylene-methyl acrylate copolymers and the like, polystyrene, polyvinyl butyral, polyurethanes, polyamides, polyesters, rosin, rosin derivatives, terpene resins, petroleum hydrocarbon resins, and the like. These polymer materials may be used singly or in combination, or may further comprise various additives such as fillers, surface active agents and the like, thereby giving polymer compositions.

The dye-receiving layer 2 is a layer which contains at least a resin on which a dye, particularly a disperse dye, sublimating from a dye transfer sheet is likely to deposit. In particularly, a preferable dye-receiving layer 2 is made of polyester resins, acrylic resins, epoxy resins, urethane resins and the like. These resins are usually formed by coating techniques. For this purpose, aqueous paints or non-aqueous paints using organic solvents may be used. As a matter of course, an anchor coating may be applied prior to coating of the paints.

One of preferable dye-receiving layers is a layer which is obtained by applying an aqueous paint comprising the following ingredients (a), (b) and (c) on the substrate:

(a) a dye-receiving resin soluble or dispersable in water;
(b) an aqueous dispersion of a mixture of a silane copolymer having silane units therein in the form of an emulsion and colloidal silica; and
(c) a releasing surface active agent soluble in water.

The water-soluble or dispersable dye-receiving resin (a) is a resin which has high affinity for sublimable dyes and is capable of stably receiving the dye. Examples of such resins include saturated linear polyester resins, epoxy resins, cellulose acetate resins, polyamide resins, urethane resins and the like.

The silane copolymers used in the dispersion (b) should preferably have hydrolyzable groups which are able to react with the colloidal silica, and may be copolymers of vinyl silane monomers and acrylic monomers. These copolymers are prepared by emulsion copolymerization of these monomers in the presence of anionic or nonionic surface active agents. Specific examples of these copolymers include copolymers of vinyl trimethoxysilane/butyl acrylate/methyl methacrylate, vinyl triethyoxysilane/2-ethylhexyl acrylate/-methyl methacrylate, vinyl methoxysilane/butyl acrylate/styrene, vinyl triacetoxysilane/butyl acrylate/methyl acrylate, and the like.

The colloidal silica may be a sol of ultrafine silica powder having a primary particle size of from 5 to 50 mμ and is usually added to the silane copolymer emulsion in an amount of from 1 to 200 parts by weight per 100 parts by weight of the solid copolymer. The colloidal silica may be added to the emulsion during the emulsion polymerization or after formation of the emulsion.

The water-soluble, releasing surface active agents have the effect of preventing the fusion between the dye or colorant layer of a dye transfer sheet and the dye-receiving layer of the dye-receiving sheet as will occur during thermal printing. Typical examples of the agents include various organic surface active agents, silicone surface active agents, fluorine-containing surface active agents and the like.

The mixing ratios of these ingredients (a), (b) and (c) in the aqueous paint are not critical, but better results are obtained when the ingredient (a) as a solid is used in an amount of from 50 to 90 wt % of the total solids in the aqueous paint. The ingredient (c) is generally used in amounts not larger than 10 wt % of the total solids in the aqueous paint.

Alternatively, the dye-receiving layer may be formed of a cured product of a curable resin, or a composition comprising such a cured product. This type of dye-receiving layer is favorable because of the good adhesion with the substrate. Curable resins may comprise curing initiators, sensitizers and the like, if necessary, and can be cured by application of heat, high frequency energy, corpuscular radiation and combinations thereof. Various curable resins which can be cured by the use of curing initiators such as isocyanates, melamine resins, epoxy resins and the like, may be used in the practice of the invention. Examples of these types of curable resins include saturated copolymerized polyester resins, xylene resins, butyral resins and the like. Other curable resins include, for example, various acrylate resins such as polyol acrylates, polyester acrylates, polyester urethane acrylates, epoxy acrylates, urethane acrylates, silicone acrylates, polyacetal acrylates and the like, alicyclic epoxy resins, bisphenol-type epoxy resins, and the like. Of these, polyester urethane acrylate resins which have poor adhesion to a polyethylene terephthalate film are very useful in good adhesion to the substrate used in the present invention.

In particular, polyester urethane acrylate resins of the following general formula can yield a dye-receiving layer which has a high heat resistance, good dye receptivity without involving any bleeding of dye, and good adhesion to the substrate

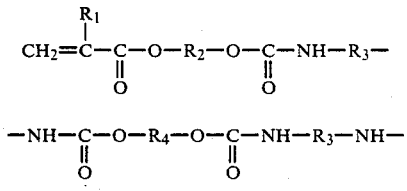

-continued

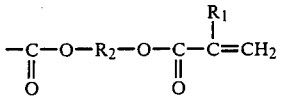

in which each $R_1$ represents —H or —$CH_3$, each $R_2$ represents a dihydric alcohol residue, each $R_3$ represents an organic diisocyanate residue, and $R_4$ represents a residue of a polyester having a hydroxyl group at both ends and a molecular weight not larger than 3,000.

The dihydric alcohol residue represented by $R_2$ is a group derived from a compound having two alcoholic hydroxyl groups. Examples of such compounds include ethylene glycol, 1,2-propanediol, 1,3-propanediol, 2,2-dimethyl-1,3-propanediol, 1,3-butanediol, 1,4-butanediol, 1.5-pentanediol, 1,6-hexanediol, 1,9-nonanediol, 1,4-cyclohexanediol and the like. Preferably, the dihydric alcohols are those having not larger than 6 carbon atoms because of the high heat resistance.

The organic diisocyanate residues represented by $R_3$ are groups derived from organic diisocyanates. The organic diisocyanates include, for example, tolylene diisocyanate, naphthylene diisocyanate, pyrene diisocyanate, nitrodiphenyl diisocyanate, diphenylsulfone. diisocyanate, diphenylmethane diisocyanate, tolylene diisocyanate dimer, isophorone diisocyanate, xylylene diisocyanate, hexamethylene diisocyanate, methylenebis(4-cyclohexyl isocyanate) and the like. Of these, tolylene diisocyanate having good characteristic properties and isophorone diisocyanate, xylylene diisocyanate, hexamethylene diisocyanate and methylenebis(4-cyclohexyl isocyanate), which do not undergo any yellowing, are preferred.

The residue of the polyester represented by $R_4$ is a group derived from a polyester which is prepared from a polybasic acid and a polyhydric alcohol, and should have a molecular weight not larger than 3,000. The polybasic acids may be saturated and/or unsaturated polybasic acids and mixtures thereof. Examples of the saturated polybasic acids include succinic acid, adipic acid, pimelic acid, azelaic acid, sebacic acid, phthalic acid, isophthalic acid, terephthalic acid and the like, and examples of the unsaturated polybasic acids include maleic acid, fumaric acid, itaconic acid and the like.

The polyhydric alcohols are compounds having at least two alcoholic hydroxyl groups and include not only the dihydric alcohols indicated before, but also trimethylolpropane, 1,2,6-hexanetriol, pentaerythritol, glycerine and the like. These alcohols may be used singly or in combination.

Figure 2:
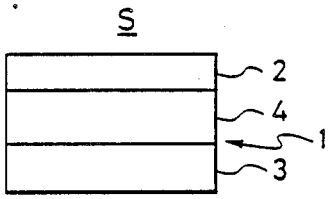
FIGS. 2 and 3 are similar to FIG. 1, showing dye-receiving sheets according to further embodiments of the invention, respectively.
Figure 3:
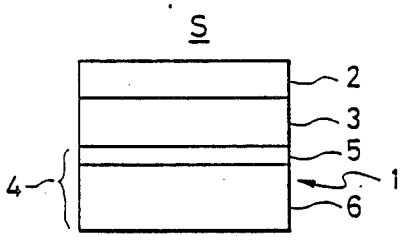

Further embodiments of the invention are shown in FIGS. 2 and 3. In FIG. 2, there is shown a dye-receiving sheet S in which the dye-receiving layer 2 is formed on the polymer layer 4 of the composite film substrate 1. In other words, the polymer layer 4 is formed between the dye-receiving layer 2 and the extruded sheet 3. In the embodiment shown in FIG. 3, the polymer layer 4 is made of an adhesive layer 5 and a synthetic paper 6, which is used for lamination of the synthetic paper 6 on the extruded sheet 3, thereby forming a composite film substrate 1. The dye-receiving layer 2 is formed on the extruded sheet 3, but may be formed on the synthetic paper 6.

The thickness of the polymer layer 4 may be at least about 1 micrometer when the layer 4 is sandwiched between the extruded sheet 3 and the dye-receiving layer 2 as shown in FIG. 2. If, however, the polymer layer 4 is formed on opposite side with respect to the dye-receiving layer 2 as in the cases of FIGS. 1 and 3, good results are obtained at a thickness of about 1/10 of the thickness of the extruded sheet.

The present invention is more particularly described by way of examples. A comparative example is also shown.

EXAMPLE 1

An extruded, stretched sheet, which had a softening point of 120° C. when measured by a penetration method using a thermo-mechanical analyzer and which had a thickness of 50 micrometers and was made of a mixture of a polyethylene terephthalate and barium sulfate used in an amount of 20 wt % of the mixture, was first provided. A vinyl chloride-vinyl acetate copolymer having a softening point of 68° C. when measured by the same method as set forth above, was applied onto one side of the extruded sheet to form a polymer layer having a thickness of 25 micrometers. The total thickness of the resultant composite substrate was thus 75 micrometers.

An aqueous emulsion of a polyester resin (MD 1200, available from Toyobo Co., Ltd.) was applied onto the other side of the extruded sheet to give an about 0.5 micrometer thick anchor coating. Thereafter, a coating paint comprised of 100 parts by weight of a polyester resin (MD 1200), 90 parts by weight of colloidal silica (Snowtex, available from Nissan Chemical Industries, Ltd.), and 0.4 parts by weight of a surface active agent (L7001, available from Nippon Unicar Co., Ltd.) were coated onto the anchor coating to form an about 3 micrometer thick dye-receiving layer.

Separately, a dye transfer sheet was obtained by coating, on one side of a 4 micrometer thick polyamide film, an ink composition comprising 3 parts by weight of a sublimable disperse dye of the following structural formula, 4 parts by weight of a polycarbonate resin, and 100 parts by weight of methylene chloride

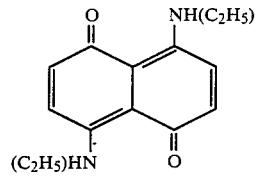

The dye-receiving sheet and the dye transfer sheet were placed between a thermal head and a platen of a printing apparatus so that the dye-receiving layer and the ink layer were arranged to face each other, and printed at a load of about 4 kg under the following printing conditions.

Main and sub-scanning dot density: 4 dots/mm

Printing power: 0.7 W/dot

Heating time of the head: 8 ms.

The resultant record on the dye-receiving sheet had a print density of 1.4.

EXAMPLE 2

A 75 micrometer thick, extruded, stretched sheet (75E20, available from Toray Co., Ltd.) of a mixture of titanium dioxide and a polyethylene terephthalate resin was provided. A coating composition comprised of 25 parts by weight of an ethylene-vinyl acetate copolymer resin (360, from Mitsui Polychemicals Co., Ltd.), 10 parts by weight of calcium carbonate (Whiton SB, available from Shiraishi Calcium Kaisha) and 75 parts by weight of toluene was applied onto one side of the extruded sheet to form a 25 micrometer thick polymer layer. Thereafter, the procedure of Example 1 was repeated to form an about 0.5 micrometer thick anchor coating and an about 3 micrometer thick dye-receiving layer on the polymer layer in this order.

The printing was effected using the same dye transfer sheet and printing conditions as used in Example 1, with the result that the print density was 1.50.

EXAMPLE 3

A 75 micrometer thick, extruded and stretched sheet made of calcium carbonate and a polyethylene terephthalate resin was applied on one side thereof with the same polymer layer as used in Example 2. An aqueous dispersion of 66.6 parts by weight of a polyester resin emulsion (Vylonal MD-1200, available from Toyobo Co., Ltd.), 31.6 parts by weight of an emulsion of a silane polymer containing colloidal silica (Mowinyl 8020, Hoechst Gosei Co., Ltd.), and 1.8 parts by weight of a surface active agent (PEG6000S, available from Sanyo Chemical Industries, Ltd.) was applied onto the polymer layer by means of a wire rod and dried to obtain a dye-receiving sheet having an about 6 micrometer thick dye-receiving layer.

The printing was effected using the same dye transfer sheet and printing conditions as used in Example 1, with the result that the print density was 1.54.

COMPARATIVE EXAMPLE

A 75 micrometer thick, extruded and stretched sheet made of barium sulfate and a polyethylene terephthalate was provided, on which an about 0.5 micrometer thick anchor coating and an about 3 micrometer thick dye-receiving layer were formed in this order in the same manner as in Example 1 to obtain a dye-receiving sheet A.

Similarly, the above procedure was repeated except that a 100 micrometer thick, extruded and stretched sheet made of titanium dioxide and a polyethylene terephthalate resin was used, thereby obtaining a dye-receiving sheet B.

Moreover, a 100 micrometer thick, extruded and stretched sheet made of calcium carbonate and a polyethylene terephthalate as provided, on which an about 6 micrometer thick dye-receiving layer was formed on the sheet in the same manner as in Example 3, thereby obtaining a dye-receiving sheet C.

The printing was effected using the same dye transfer sheet and printing conditions as used in Example 1, with the result that the print densities of the sheets A, B and C were, respectively, 1.30, 1.25 and 1.33.

What is claimed is:

1. A dye-receiving sheet which is used in combination with a sublimable dye transfer sheet, said dye-receiving sheet comprising film made of an extruded sheet of white fine particles and a polyester resin and a layer of a polymer material formed on at least one side of said extruded sheet and having a thermal deformation temperature or softening point lower than said extruded sheet, and a dye-receiving layer formed on the polymer material layer or on the other side of said extruded sheet, said dye-receiving layer being formed from an aqueous composition comprising a water-soluble or water-dispersable dye-receiving resin, an aqueous dispersion of colloidal silica in a silane copolymer emulsion, and a surface active agent.

2. A dye-receiving sheet according to claim 1, wherein said extruded sheet has a specific density not larger than 1.38.

3. A dye-receiving sheet according to claim 1, wherein said white fine particles are made of titanium oxide.

4. A dye-receiving sheet according to claim 1, wherein said white fine particles are made of barium sulfate.

5. A dye-receiving sheet according to claim 1, wherein said white fine particles are made of calcium carbonate.

6. A dye-receiving sheet according to claim 1, wherein said white fine particles are treated with a surface improver.

7. A dye-receiving sheet according to claim 1, wherein said polyester resin is a polyethylene terephthalate resin or a polyethylene naphthalate resin.

8. A dye-receiving sheet according to claim 1, wherein said layer of the polymer material is laminated on said at least one side through an adhesive layer.

9. A dye-receiving sheet according to claim 1, wherein said layer of the polymer material has a multi-layered structure which includes a sub-layer of a polymer whose thermal deformation temperature or softening point is lower than said extruded sheet.

10. A dye-receiving sheet according to claim 1, wherein said dye-receiving layer is formed on said polymer material layer.

11. A dye-receiving sheet according to claim 1, wherein said dye-receiving layer is formed on the other side of said extruded sheet.

12. A dye-receiving sheet according to claim 1, wherein said dye-receiving resin is contained in an amount of from 50 to 90 wt % of the total solids in said aqueous composition.

13. A dye-receiving sheet according to claim 12, wherein said dye-receiving resin is a member selected from the group consisting of saturated linear polyester resins, epoxy resins, cellulose acetate resins, polyamide resins, and urethane resins.

14. A dye-receiving sheet according to claim 1, wherein said silane copolymer has hydrolyzable groups reacting with the colloidal silica.

15. A dye-receiving sheet according to claim 1, wherein said colloidal silica is in the form of a powder having primary particle sizes of from 5 to 50 mu.

16. A dye-receiving sheet according to claim 1, wherein said surface active agent is contained in amounts not larger than 10 wt % of the total solids in the aqueous composition.

17. A dye-receiving sheet which is used in combination with a sublimable dye transfer sheet, said dye-receiving sheet comprising a composite film made of an extruded sheet of white fine particles and a polyester resin and a layer of a polymer material formed on at least one side of said extruded sheet and having a thermal deformation temperature or softening point lower than said extruded sheet, and a dye-receiving layer formed on the polymer material layer or on the other side of said extruded sheet, said dye-receiving layer being made of a cured product of a polyester urethane acrylate of the following formula

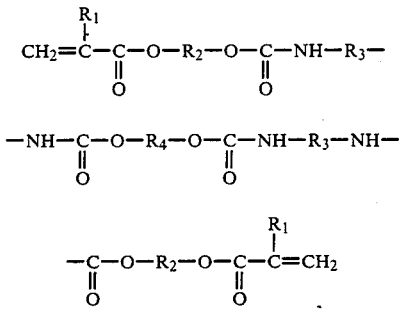

in which each $R_1$ represents —H or —$CH_3$, each $R_2$ represents a dihydric alcohol residue, each $R_3$ represents an organic diisocyanate residue, and $R_4$ represents a residue of a polyester having a hydroxyl group at both ends and a molecular weight of not larger than 3000.

18. A dye-receiving sheet according to claim 17, wherein said extruded sheet has a specific density not larger than 1.38.

19. A dye-receiving sheet according to claim 17, wherein said white fine particles are made of titanium oxide.

20. A dye-receiving sheet according to claim 17, wherein said white fine particles are made of barium sulfate.

21. A dye-receiving sheet according to claim 17, wherein said white fine particles are made of calcium carbonate.

22. A dye-receiving sheet according to claim 17, wherein said white fine particles are treated with a surface improver.

23. A dye-receiving sheet according to claim 17, wherein said polyester resin is a polyethylene terephthalate resin or a polyethylene naphthalate resin.

24. A dye-receiving sheet according to claim 17, wherein said layer of the polymer material is laminated on said at least one side through an adhesive layer.

25. A dye-receiving sheet according to claim 17, wherein said layer of the polymer material has a multi-layered structure which includes a sub-layer of a polymer whose thermal deformation temperature or softening point is lower than said extruded sheet.

26. A dye-receiving sheet according to claim 17, wherein the dihydric alcohol residue represented by $R_2$ is a residue of a dihydric alcohol having not larger than 6 carbon atoms.

27. A dye-receiving sheet according to claim 17, wherein the organic diisocyanate residue represented by $R_3$ is a group derived from an organic diisocyanate selected from the group consisting of tolylene diisocyanate, isophorone diisocyanate, xylylene diisocyanate, hexamethylene diisocyanate and methylenebis(4-cyclohexyl isocyanate).

* * * * *